United States Patent [19]

Lattner et al.

[11] Patent Number: 4,912,919

[45] Date of Patent: Apr. 3, 1990

[54] ROVING STOP MOTION FOR A SPINNING MACHINE DRAFTING SYSTEM

[75] Inventors: Manfred Lattner, Ebersbach-Sulpach; Helmut Nickolay, Goppingen, both of Fed. Rep. of Germany

[73] Assignee: Zinser Textilmaschinen GmbH, Fed. Rep. of Germany

[21] Appl. No.: 183,593

[22] Filed: Apr. 19, 1988

[30] Foreign Application Priority Data

Apr. 30, 1987 [DE] Fed. Rep. of Germany ..... 3714548

[51] Int. Cl.[4] ..... D01H 13/18; D01H 13/14

[52] U.S. Cl. ..... 57/84; 19/0.25; 57/80; 57/87

[58] Field of Search ..... 57/80, 84, 86, 87; 19/0.25, 244

[56] References Cited

U.S. PATENT DOCUMENTS 4,630,434 12/1986 Hartmannsgruder et al. ..... 57/87
4,644,609 2/1987 Lattner ..... 19/244
4,727,713 3/1988 Konig et al. ..... 19/0.25 X
4,763,467 8/1988 Nickolay et al. ..... 57/86 X

FOREIGN PATENT DOCUMENTS 3606609 9/1987 Fed. Rep. of Germany .

*Primary Examiner*—John Petrakes
*Attorney, Agent, or Firm*—Shefte, Pinckney & Sawyer

[57] ABSTRACT

An improvement in a roving stop motion for a spinning machine of the type having a series of pairs of drafting rollers, the stop motion including a clamping member mounted on a lever arm drivenly connected to an actuating rod by a carriage which is selectively mountable at differing locations along the actuating rod. The actuating rod is responsive to roving breakage to drive the lever arm to cause the clamping member to separate the feed rollers from one another and press the roving against one roller. The positionability of the carriage enables the lever arm to be properly disposed with respect to the feed rollers when the spacing between the roller pairs is varied.

3 Claims, 1 Drawing Sheet

ROVING STOP MOTION FOR A SPINNING MACHINE DRAFTING SYSTEM

BACKGROUND OF THE INVENTION

The present invention relates to a roving stop motion arrangement for a spinning machine of the type having a roving drafting system including a series of drafting roller pairs. More particularly, the present invention relates to such a roving stop motion of the type wherein a clamping member operated by a lever arm driven from an actuating rod is adapted to enter between a pair of roving feed rollers to separate them from one another and press the traveling roving against one roller.

In spinning machines of the aforementioned type, it is the current practice to change the distances between the individual pairs of rollers in the roving drafting system according to the constituent fiber makeup of the roving being processed. However, in doing so, it is difficult to maintain proper functioning of a roving stop motion of the aforementioned type when a change in the distance between the roller pairs of the drafting system is made because the drive connection between the lever arm and the actuating rod of the stop motion must also be changed. Thus, to accommodate such changes, the actuating rod must be sufficiently long so that a suitable drive connection can be made with the lever arm when the drafting roller pairs are positioned in their most closely spaced disposition with the pair of feed rollers positioned in their farthest forward disposition (in relation to the direction of roving travel), but the actuating rod on the other hand must not be so long that it interferes with the other drafting roller pairs when in their greatest spaced disposition to one another with the feed roller pair positioned in its farthest rearward disposition. Particularly, in spinning machines wherein an endless apron is trained about each roller of the pair following the roving feed rollers, it is especially important that the actuating rod avoid interference with the traveling apron in each possible disposition of the following roller pair.

It is accordingly an object of the present invention to provide a roving stop motion for a spinning machine of the aforementioned type which is adapted to be fully functional even at extreme spacings between the roller pairs of the drafting system of the spinning machine.

SUMMARY OF THE INVENTION

In accordance with the foregoing object, the roving stop motion of the present invention is adapted for use in a spinning machine of the type having a roving drafting arrangement including a pair of roving feed rollers defining a nip therebetween for transporting a traveling roving. The roving stop motion includes an actuating rod, a drive arrangement including a lever arm operably associated with the actuating rod, and a clamping member operably associated with the lever arm. The actuating rod is responsive to roving breakages for driving the clamping member by the lever arm to enter the nip between the feed rollers for separating them and pressing the roving against one of the rollers. According to the present invention, a carriage is mounted on the actuating rod for selective positioning and locking at differing locations along the actuating rod, with the drive arrangement being arranged on the carriage. Advantageously, the carriage may be displaced and locked on the actuating rod in accordance with the desired distance between the individual roller pairs of the spinning machine drafting system, so that the roving stop motion, which is known per se, retains its full functioning capability even at differing distances between the roller pairs.

According to the preferred embodiment of the present invention, the drive arrangement is asymmetrically arranged on the carriage with respect to the longitudinal extent of the actuating rod, and the carriage is adapted for selective repositioning and locking on the actuating rod in opposed dispositions turned 180 degrees to one another with respect to the longitudinal extent of the actuating rod. In this manner, a 180 degree repositioning of the carriage is effective to vary the relative disposition of the asymmetrical drive arrangement with respect to the longitudinal extent of the actuating rod to adapt to even extreme spacings between the roller pairs of the spinning machine drafting system without adversely affecting the functional capability of the stop motion.

According to a further feature of the invention, the drive arrangement may be located at one end of the carriage. In addition, the lever arm may include a pair of prongs forming a forked mounting portion for connection to the drive arrangement, with the actuating rod being connected with the carriage between the prongs of the lever arm.

DESCRIPTION OF THE PREFERRED EMBODIMENT

Figure 1:
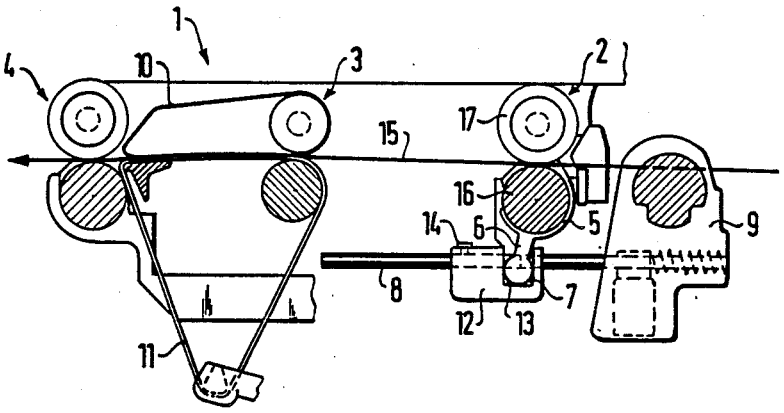
FIG. 1 is a side view, partially in side elevation and partially in vertical cross-section, of a drafting system of a spinning machine, with the several pairs of drafting rollers relatively widely spaced from one another with the feed roller pair in a relatively rearward disposition.

Referring now to the accompanying drawings and initially to FIG. 1, a drafting system of a textile spinning machine is indicated generally at 1 and basically comprises a series of three pairs of drafting rollers spaced along the path of movement of a traveling roving 15, namely, a first rearward pair of feed rollers indicated at 2, an intermediate pair of rollers indicated at 3 respectively having top and bottom aprons 10 and 11 trained thereabout, and a forward pair of withdrawal rollers indicated at 4. The individual rollers of each roller pair 2,3,4 are disposed with respect to one another to define a nip therebetween for transporting the traveling roving 15 in its path of movement. The upper apron 10 and the bottom apron 11 associated with the rollers of the intermediate roller pair 3 are guided in a known conventional fashion which need not be described or illustrated in detail herein.

The drafting system 1 is provided with a roving stop motion associated with the individual rollers 16 and 17 of the rearward roller pair 2. Specifically, the stop motion includes a clamping member 5 mounted in association with the bottom feed roller 16 on a lever arm 6 drivenly connected with an actuating rod 8 supported for forward and rearward reciprocal displacement in a bearing section 9 of the drafting system. The actuating rod 8 is arranged in a known fashion (not shown) to be responsive to breakages of the traveling roving 15 so as to drive the lever arm 6 to move the clamping member 5 to enter the nip between the feed rollers 16,17 to separate them from one another and thereby press the roving 15 against the upper feed roller 17.

According to the present invention, drive connection between the operating rod 8 and the lever arm 6 associated with the clamping member 5 is provided by a carriage 12 which is adapted to be selectively positioned and locked by a clamping screw 14 at substantially any location along the longitudinal extent of the actuating rod 8. The carriage 12 is provided with a drive portion 7 in the form of a recess 13 in which the lever arm 6 associated with the clamping member 5 is received. In this manner, longitudinal reciprocal movement of the actuating rod 8 produces corresponding movement of the carriage 12 and its drive portion 7 to engage the lever arm 6 and thereby actuate pivotal movement of the clamping member 5 to enter and withdraw from the nip between the feed rollers 16,17 whenever actuation or deactuation of the roving stop motion is necessary.

As will be appreciated from the drawings, the drive portion 7 is located at one longitudinal end of the carriage 12 asymmetrically with respect to the longitudinal axis of the actuating rod 8. In other words, when the carriage 12 is mounted on the actuating rod 8, as see in FIG. 1, the drive portion 7 is disposed at the rearwardmost end of the carriage 12, i.e. at the rightward end thereof as viewed in FIG. 1. In this disposition, the drive portion 7 is properly disposed for operative engagement with the lever arm 6 in a rearwardmost disposition of the feed rollers 16,17, the asymmetrical arrangement of the drive portion 7 preventing the carriage 12 in this position from coming into interfering contact with the bearing section 9.

Figure 2:
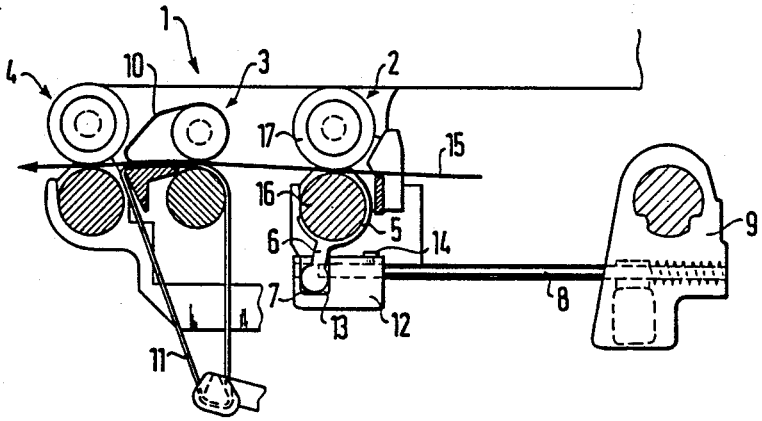
FIG. 2 is a similar view of the drafting system of FIG. 1, illustrating the roller pairs relatively closely spaced with the feed roller pair in a relatively forward disposition.

If it becomes necessary or desirable to change the respective spacings between the roller pairs 2,3,4, such as illustrated in FIG. 2, then upon loosening of the clamping screw 14 the carriage 12 may be displaced forwardly along the actuating rod 8, i.e. leftwardly as viewed in FIG. 2, to any desired disposition along the actuating rod 8 and then locked in position by re-tightening the clamping screw 14. Further, the carriage 12 may be turned 180 degrees with respect to the lengthwise extent of the actuating rod 8 to dispose the drive portion 7 relatively forward with respect to the carriage 12, as depicted in FIG. 2, enabling the drive portion 7 to be disposed in an extreme forwardmost position projecting beyond the end of the actuating rod 8 to in effect extend its operative length for operating the lever arm 6. In this manner, proper drive relationship with the lever arm 6 may be maintained even in an extreme forwardmost disposition of the feed rollers 16,17 at a very close spacing to the middle roller pair 3 without the carriage 12 interfering with the apron 11 associated with the roller pair 3.

Figure 3:
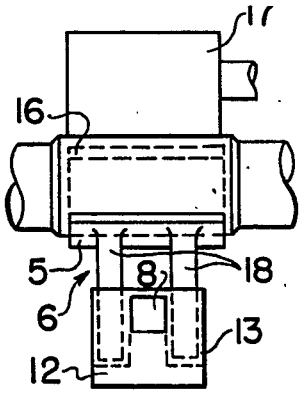
FIG. 3 is a cross-sectional view of the drive arrangement of the roving stop motion taken along line 3—3 of FIG. 2.

As seen in FIG. 3, the lever arm 6 associated with the clamping member 5 may preferably be of a forked configuration having a pair of spaced prongs 18 forming a mounting portion for disposition within the recess 13 of the drive portion 7 of the carriage 12, with the actuating arm 8 extending between the prongs 18.

As will thus be understood by those persons skilled in the art, the described special design and configuration of the carriage 12 enabling it to be displaced and locked at differing dispositions along the length of the actuating rod as well as being turnable 180 degrees, provides a simple means for insuring that the roving stop motion on the drafting system of the spinning machine may at all times be maintained in proper operative disposition with respect to the feed rollers 16,17 for full functional capability at all possible operative spacing between the feed roller pair 2 and the other roller pairs of the drafting system.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Roving stop motion means for a spinning machine having roving drafting means including a pair of roving feed rollers defining a nip therebetween for transporting a traveling roving, said roving stop motion means comprising an actuating rod, drive means including a lever arm operably associated with said actuating rod, and a clamping member operably associated with said lever arm, said actuating rod being responsive to roving breakage for driving said clamping member by said lever arm to enter the nip between said feed rollers for separating said feed rollers and pressing the roving against one said roller, the improvement comprising carriage means mounted on said actuating rod for selective positioning and locking at differing locations along said actuating rod, said drive means being arranged on said carriage means asymmetrically with respect to the longitudinal extent of said actuating rod, and said carriage means being arranged on said actuating rod for selective repositioning and locking thereon in opposed dispositions turned 180 degrees to one another with respect to the longitudinal extent of said actuating rod.

2. The improvement in roving stop motion means according to claim 1 and characterized further in that said drive means is arranged at one end of said carriage means.

3. The improvement in roving stop motion means according to claim 1 and characterized further in that said lever arm includes a pair of prongs forming a forked mounting portion connected to said drive means and said actuating rod is connected with said carriage means between said prongs of said lever arm.

* * * * *